US006474592B1

(12) United States Patent
Shnaps

(10) Patent No.: US 6,474,592 B1
(45) Date of Patent: Nov. 5, 2002

(54) SYSTEM AND METHOD FOR MUNITION IMPACT ASSESSMENT

(75) Inventor: Moshe Shnaps, Elad (IL)

(73) Assignee: Tadiran Spectralink Ltd., Holon (IL)

( * ) Notice: Subject to any disclaimer, the term of this patent is extended or adjusted under 35 U.S.C. 154(b) by 0 days.

(21) Appl. No.: 09/864,315

(22) Filed: May 25, 2001

(51) Int. Cl.[7] ..... F42B 15/01
(52) U.S. Cl. ..... 244/3.15; 89/1.11; 102/211
(58) Field of Search ..... 244/3.11, 3.12, 244/3.13, 3.14, 3.19; 102/211, 213, 214, 216; 89/1.11

(56) References Cited

U.S. PATENT DOCUMENTS 4,185,796 A * 1/1980 Riley
4,222,306 A * 9/1980 Maury
4,796,834 A * 1/1989 Ahlstrom
5,035,375 A * 7/1991 Friedenthal et al.
5,102,065 A * 4/1992 Couderc et al.
5,214,584 A * 5/1993 Dingee
5,866,838 A * 2/1999 Mayersak
6,113,027 A * 9/2000 Redford
6,144,899 A * 11/2000 Babb et al.
6,163,372 A * 12/2000 Sallee et al.
6,302,355 B1 * 10/2001 Sallee et al.
6,345,784 B1 * 2/2002 Schnaps

* cited by examiner

*Primary Examiner*—Michael J. Carone
*Assistant Examiner*—Troy Chambers
(74) *Attorney, Agent, or Firm*—Mark M. Friedman

(57) ABSTRACT

A platform launched or dropped self guided munition is disclosed. The munition comprises a body and flight control mechanism operative therewith, the body housing (a) an onboard guidance system for controlling the flight control mechanism, so as to guide the self guided munition to a target; and (b) an impact verification assembly including (i) a processing unit for receiving and processing information from the onboard guidance system, the information pertaining to an in-flight trajectory position of the self guided munition prior to impact, the processing unit further being for generating a signal including information pertaining to an accuracy, with respect to the target, of the in-flight trajectory position of the self guided munition prior to impact; and (ii) a transmitter being in communication with the processing unit, the transmitter being for transmitting the signal generated by the processing unit in a manner receivable by a receiving device of the platform.

26 Claims, 2 Drawing Sheets

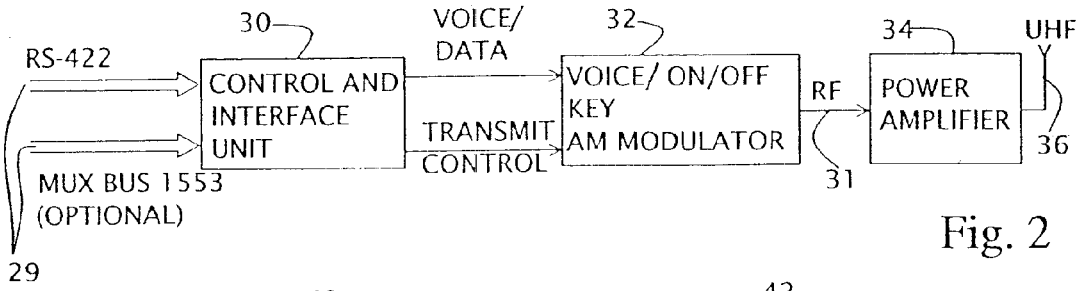
Fig. 2
Fig. 3
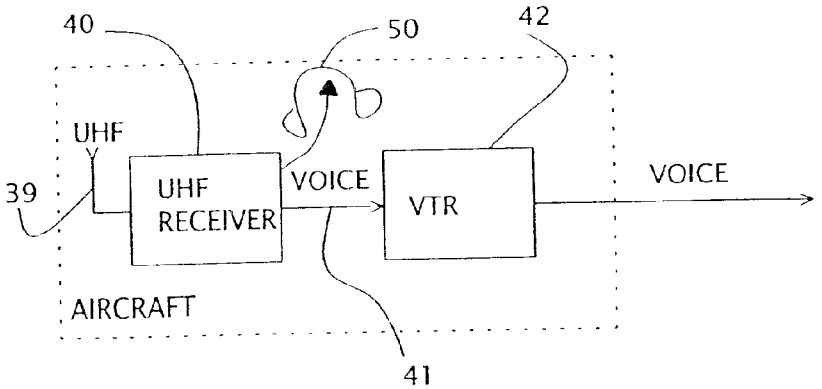
Fig. 4
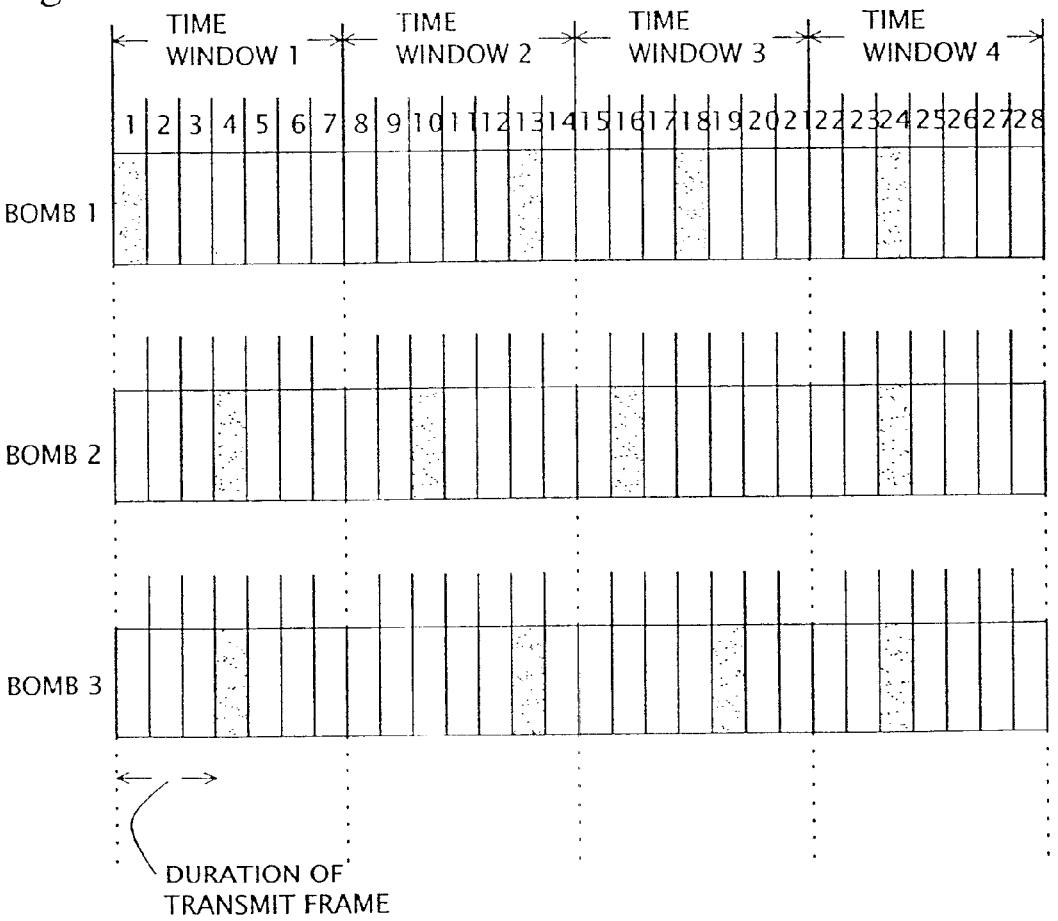

SYSTEM AND METHOD FOR MUNITION IMPACT ASSESSMENT

FIELD AND BACKGROUND OF THE INVENTION

The present invention relates to a system and method for munition impact assessment. More particularly, the present invention relates to a self guided munition including an impact assessment system, which system transmits a signal pertaining to impact assessment of the munition directly to a platform from which the munition was launched or dropped.

The use of platform launched or dropped munitions in warfare is well known. The use of such munitions has provided a substantial advance in the art of warfare by facilitating the destruction of enemy targets while mitigating undesirable loss of life and/or destruction of military equipment.

However, as those skilled in the art will appreciate, conventional un-guided munitions dropped or launched by, for example, airplanes, must generally either be released with very high accuracy or in very large numbers in order to effectively destroy a desired target. Thus, it is frequently necessary to either drop such munitions from an undesirably low altitude or to fly an undesirably large number of sorties. Dropping conventional munitions from a lower than desirable altitude exposes the aircraft and crew to hazardous anti-aircraft artillery and ground-to-air missiles. The accuracy of such anti-aircraft artillery and ground-to-air missiles is substantially enhanced by the reduced range to target (altitude of the aircraft) provided by such low flight. For this reason, low altitude bombing is extremely dangerous and is very rarely performed. Of course, flying an undesirably large number of sorties is expensive, time consuming, and exposes the aircraft and crew repeatedly to air defense weaponry such as anti-aircraft artillery and ground-to-air missiles.

In an attempt to overcome the deficiencies of conventional munitions in reliably destroying ground targets, particularly when dropped from a high altitude and away in ground distance from the target, smart munitions have been developed. Such smart munitions utilize a guidance and flight control system to accurately maneuver the munition to the desired target. The guidance system provides a control signal to the control surfaces based upon the present position of a munition and the position of the target, so that the control surfaces maneuver the munition toward the target. Such guidance systems operate according to well known principles and typically utilize technologies such as laser guidance, infrared guidance, radar guidance and/or satellite (GPS) guidance.

For example, U.S. Pat. No. 5,866,838 to Mayersak describes a low cost and highly accurate guided system suitable for use in conventional aircraft launched bombs. The system includes a kit mounted upon the nose of the conventional bomb which replaces the conventional fuse disposed in a fuse well, the kit including guidance electronics controlling a self-contained jet reaction device and GPS P-code receiver electronics. The bombs are readied for discharge by radio frequency signals broadcast from the aircraft into the bomb bay which transfer initial GPS data and commence operation of a gas generator which powers the jet reaction device.

Such smart munitions can be either self guided, wherein a bomb or a missile is launched and self guides to the target, or alternatively such smart bombs can be guided or monitored by an operator, in which case the operator ensures and/or verifies that the bomb has detonated on target.

An inherent limitation to self guided smart bombs is the inability to verify if the bomb detonated with precision on target. Thus, an aircraft pilot launching a self guided smart bomb cannot verify successful impact other than by flying over the target, thus risking the aircraft to anti aircraft fire.

To overcome this limitation, smart self guided bomb systems have been devised by which a likely detonation coordinate signal is relayed from the smart bomb to a tracking station just prior to detonation. Such a signal is then processed by the tracking station and compared to the intended target coordinate to yield accuracy results.

Since the presence of a tracking station is required in order to monitor and interpret a bombing run, real-time analysis of the results cannot be enabled, and as such these systems are typically used only to verify success and not to adjust additional bombing runs of a sortie according to detonation results of a previous bombing run.

There is thus a widely recognized need for, and it would be highly advantageous to have, an impact verification system for self guided smart bombs which system can transmit a signal relating to impact success or failure of a self guided smart bomb, directly to a platform from which the smart bomb was launched or dropped.

SUMMARY OF THE INVENTION

According to one aspect of the present invention there is provided a platform launched or dropped self guided munition comprising a body and flight control mechanism operative therewith, the body housing (a) an onboard guidance system for controlling the flight control mechanism, so as to guide the self guided munition to a target; and (b) an impact verification assembly including (i) a processing unit for receiving and processing information from the onboard guidance system, the information pertaining to an in-flight trajectory position of the self guided munition prior to impact, the processing unit further being for generating a signal including information pertaining to an accuracy, with respect to the target, of the in-flight trajectory position of the self guided munition prior to impact; and (ii) a transmitter being in communication with the processing unit, the transmitter being for transmitting the signal generated by the processing unit in a manner receivable by a receiving device of the platform.

According to another aspect of the present invention there is provided a system for determining the impact success of a self guided munition which is launched or dropped from a platform, the system comprising an impact verification assembly being integrateable into the self guided munition, the impact verification assembly including (a) a processing unit for receiving and processing information from an onboard guidance system of the self guided munition, the information pertaining to an in-flight trajectory position of the self guided munition prior to impact, the processing unit further being for generating a signal including information pertaining to an accuracy of the in-flight trajectory position of the self guided munition prior to impact with respect to a target; and (b) a transmitter being in communication with the processing unit, the transmitter being for transmitting the signal generated by the processing unit in a manner receivable by a receiving device of the platform.

According to yet another aspect of the present invention there is provided a method of determining the impact success of a self guided munition which is launched or dropped from a platform, the method comprising the steps of (a) integrating an impact verification assembly to the self guided munition, the impact verification assembly including (i) a processing unit being for receiving and processing information from an inboard guidance system of the self guided munition, the information pertaining to an in-flight trajectory position of the self guided munition prior to impact, the processing unit further being for generating a signal including information pertaining to an accuracy of the in-flight trajectory position of the self guided munition prior to impact; and (ii) a transmitter being in communication with the processing unit, the transmitter being for transmitting the signal generated by the processing unit in a manner receivable by a receiving device of the platform; and (b) receiving via the receiving device of the platform the signal generated by the processing unit and transmitted by the transmitter so as to determine the accuracy of the in-flight trajectory position of the self guided munition prior to impact, thus determining the impact success of the self guided munition.

According to still another aspect of the present invention there is provided a method of determining the impact success of a self guided munition which is launched or dropped from a platform, the method comprising the steps of (a) processing information generated by an onboard guidance system of the self guided munition, the information pertaining to an in-flight trajectory position of the self guided munition prior to impact; (b) generating a signal including information pertaining to an accuracy, with respect to a target, of the in-flight trajectory position of the self guided munition prior to impact; and (c) transmitting the signal generated by the processing unit in a manner receivable by a receiving device of the platform so as to enable to determine the impact success of the self guided munition.

According to further features in preferred embodiments of the invention described below, the signal including information pertaining to an accuracy, with respect to the target, of the in-flight trajectory position of the self guided munition prior to impact includes information indicating an impact success or an impact failure of the self guided munition.

According to still further features in the described preferred embodiments the signal is a radiofrequency signal and further wherein the receiving device of the platform is a radiofrequency receiver.

According to still further features in the described preferred embodiments the radiofrequency receiver is inherent to a radio communication system of the platform.

According to still further features in the described preferred embodiments the radiofrequency signal is an ultra high frequency radio signal of between 200 megahertz and 400 megahertz.

According to still further features in the described preferred embodiments the radiofrequency signal is translatable into audio information.

According to still further features in the described preferred embodiments the audio information includes uttered words.

According to still further features in the described preferred embodiments in a case where the impact success of more than one of the self guided munition is to be co-assessed, the signal generated and transmitted by the impact verification assembly of each self guided munition also includes information uniquely identifying each self guided munition.

According to still further features in the described preferred embodiments the information uniquely identifying each self guided munition is transmitted as a radiofrequency signal and further wherein the receiving device of the platform is a radio frequency receiver.

According to still further features in the described preferred embodiments the radio frequency signal is translatable into audio information.

According to still further features in the described preferred embodiments the audio information includes uttered words.

According to still further features in the described preferred embodiments the uttered words include words of the international alphabet of radio communication.

According to still further features in the described preferred embodiments the signal generated and transmitted by the impact verification assembly of each self guided munition is randomly transmitted a plurality of times over a time window.

According to still further features in the described preferred embodiments the self guided munition further comprising a propulsion section including an engine and a such the self guided munition is self propelled.

According to still further features in the described preferred embodiments the platform is selected from the group consisting of an airplane, a helicopter, a ship, a ground vehicle and a personal self guided munition platform.

According to still further features in the described preferred embodiments the platform is an airplane.

According to still further features in the described preferred embodiments the platform launched or dropped self guided munition further comprising attachment elements positioned on an outer surface of the body, the attachment elements serve for attaching the self guided munition to the platform.

According to still further features in the described preferred embodiments the impact verification assembly further includes a power supply for powering the processing unit and the transmitter.

According to still further features in the described preferred embodiments the impact verification assembly includes an interface for connecting to a power supply of the self guided munition.

According to still further features in the described preferred embodiments the information pertaining to the in-flight trajectory position of the self guided munition includes a position and orientation of the self guided munition with respect to a location of the target.

According to still further features in the described preferred embodiments the target is selected from the group consisting of a stationary target and a moving target.

According to still further features in the described preferred embodiments the transmitter transmits the signal generated by the processing at any time point within a minute prior to impact.

The present invention successfully addresses the shortcomings of the presently known configurations by providing a self guided munition including an impact verification assembly which enables the operator of a platform from which the munition was dropped or launched to determine, in real time, an impact success or failure of the munition. The present invention further successfully addresses the shortcomings of the presently known configurations by being readily incorporable and deployable by existing platforms without necessitating additional platform mounted hardware or extensive operator training.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Referring to the drawings wherein:

FIG. 2 is a black box diagram depicting one embodiment of a transmitter of the impact assessment assembly of the present invention;

FIG. 3 is a black box diagram of a platform mounted receiver according to the present invention;

FIG. 4 is a diagram depicting transmission patterns over a time period of three munitions according to the present invention;

DESCRIPTION OF THE PREFERRED EMBODIMENTS

Figure 1A:
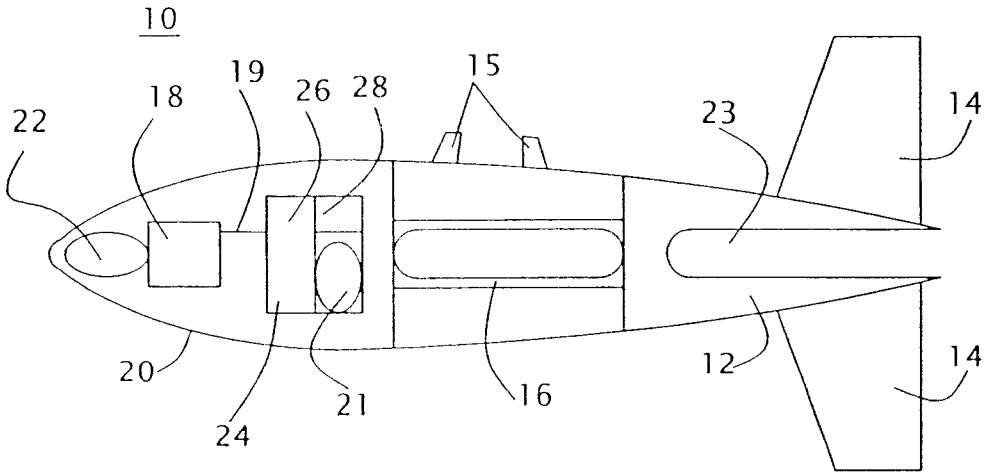
FIG. 1*a* is a cut away view of a self guided munition including an impact assessment assembly according to the teachings of the present invention.

The present invention is of a method and system and a self guided munition employing same, which can be used to determine an impact success or failure of the self guided munition. Specifically, the present invention can be used to asses impact success or failure of a self guided munition by providing an operator of a platform from which the self guided munition was deployed, with information pertaining to the position and orientation thereof with respect to a target, just prior to impact.

The principles and operation of a self guided munition according to the present invention may be better understood with reference to the drawings and accompanying descriptions.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

As used herein, the term "munition" refers to perishable military weapons such as bombs, rockets and missiles which are typically dropped or launched on specific targets from a variety of platforms such as airplanes, helicopters, ships, ground vehicles such as for example tanks, and personal platform launchers such as shoulder missile launchers and the like.

The phrase "self guided munition" refers to any munition capable of self guiding to target and as such once it is launched or dropped from a platform it self guides to a predetermined target. The target can be a stationary target such as a building a bunker and the like, or a moving target such as a ship, a train or a tank.

Figure 1B:
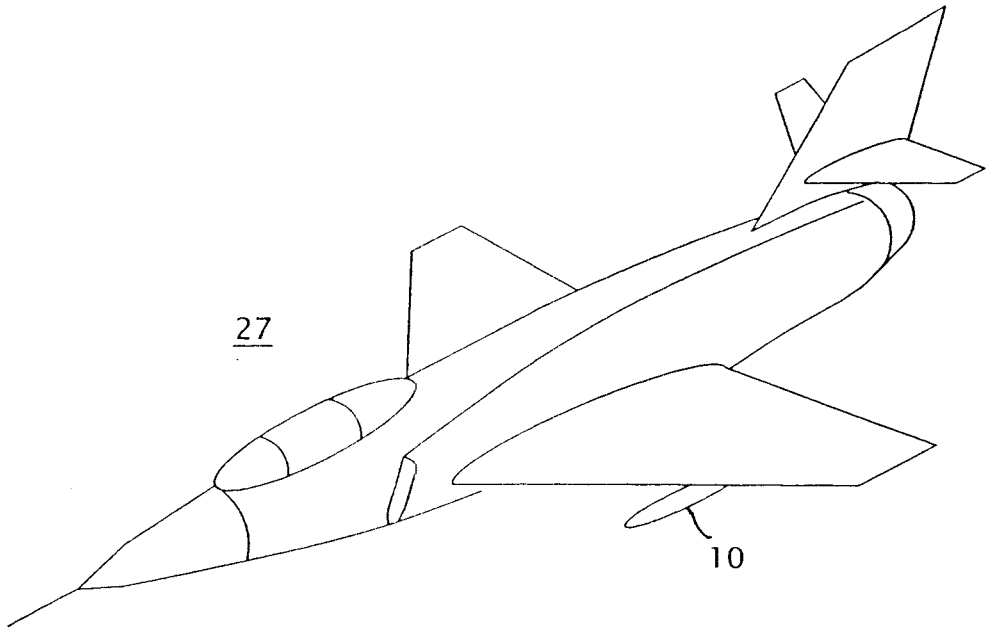
FIG. 1*b* is a perspective drawing depicting the self guided munition of FIG. 1*a* mounted onto a platform.

Referring now to the drawings, FIGS. 1*a*–4 illustrate the self guided munition according to the present invention, which is referred to hereinunder as munition 10.

Munition 10 includes a body 12, which is typically substantially cylindrical and aerodynamic, and a flight control mechanism, e.g., at least one translatable flight control surface 14 (two are shown) disposed along an outer surface of the body 12. It will be appreciated that although surfaces 14 are shown to be disposed on the outer surface of the tail section of body 12, attachment of surfaces 14 on the outer surfaces of the mid and/or forward sections of body 12 can also be realized.

Munition 10 further includes attachment elements 15 positioned on an outer surface of body 12. Attachment elements 15 serve for attaching munition 10 to a platform 27, which can be, for example, an airplane as specifically shown in FIG. 1*b*.

Body 12 houses a warhead 16 which serves to destroy a target by detonating either prior to, during or following impact of munition 10 on the target. Warhead 16 is typically a hollow cylindrical shaped casing, inside of which is placed the explosive charge. At the rear or front end of warhead 16 lies the ignition fuse which is designed to be set off at the proper moment, either prior to, during or following impact on target. Many warhead configuration and detonation mechanisms which can be utilized by warhead 16 of the present invention are known in the art, and as such no further detail to the construction and function of warhead 16 is given herein.

Body 12 further houses an onboard guidance system 18. Guidance system 18 serves to guide munition 10 to a target by controlling control surfaces 14. Several types of guidance systems are known in the art, which systems typically utilize technologies such as, but not limited to, laser guidance, infrared guidance, radar guidance and/or satellite (GPS) guidance. Guidance system is typically housed in a front section 20 of munition 10 and includes one or more sensors 22, such as a Forward Looking Infrared (FLIR) sensors in the case of infrared guidance, and the various electronic systems which control the sensors, analyze and interpret the signals received by the sensors, and control surfaces 14 which determines the trajectory and the roll position of the missile.

It will be appreciated that in the case of a self propelled munition 10 such as a missile or a rocket, body 12 further houses an engine 23 such as a solid or liquid fuel rocket engine which serves to propel munition 10 to the target.

Body 12 of munition 10 according to the present invention further houses an impact verification assembly 24. Assembly 24 is powered by an internal power supply 21, or alternatively by a power supply contained within, for example, guidance system 18 of munition 10.

Assembly 24 includes a processing unit 26 which is in data communication with guidance system 18 (indicated by 19). Unit 26 serves to process information received from onboard guidance system 18, such information can include positional coordinates of munition 10 and the target (which are typically fed into the guidance system prior to deployment) and orientation of munition 10 with respect to the target. It will be appreciated that depending on the processing abilities of guidance system 18 this information can be provided either as processed data which includes a calculated positional relationship between munition 10 and the target or alternatively as unprocessed data which includes simple coordinate data for munition 10 and target and orientation of munition 10 with respect to the horizon.

In any case processing unit 26 processes the information received from guidance system 18 to yield information pertaining to an accuracy, with respect to the target, of the in-flight trajectory position of munition 10, just prior to impact. Processor 26 generates a signal including this information and relays this signal to a transmitter 28 forming a part of assembly 24.

Transmitter 28 transmits this signal, via an antenna provided therewith, to a platform 27 (FIG. 1*b*) from which munition 10 was dropped or launched, such that an impact assessment of munition 10 can be determined by an operator of platform 27.

It will be appreciated that an impact assessment depends on the extent of target destruction which is dependent on the accuracy of munition 10, it's warhead type, warhead size and penetration ability. Thus, impact success can also be achieved when near target impact occurs, providing the explosive potential of munition 10 is such, that total or sufficient target destruction is achieved. Thus impact success is specific to each type of munition 10 deployed. Prior to deployment a threshold for impact success can be programmed into processing unit 26 for each type of munition deployed, considering parameters such as, but not limited to, the munition war head size, warhead type and penetration ability.

It will be appreciated that self guided munitions including systems which transmit a position and orientation of the munition to a tracking station exist in the art. Such systems typically transmit a signal pertaining to the position and orientation of the munition prior to impact, which signal is correlated to a position of a target targeted by the munition, thus yielding probable impact accuracy of the munition. Since accuracy assessment in this case is performed by a tracking station and not a platform from which the munition was launched or dropped, real-time analysis of impact results cannot be enabled, and as such these prior art systems are typically used only to verify success and not to adjust deployment of additional munitions.

These prior art systems typically require the use of bulky and dedicated processing and receiving units in the tracking station and as such, incorporation of such units into space limited platforms such as for example, airplanes, is a virtual impossibility. In addition, such tracking station processing and receiving units are typically expensive to fabricate and operate and as such incorporation into a multiplicity of platforms is not feasible economically.

To overcome the limitations of prior art systems the present invention makes use of the abundant space available within a munition body, to place the processing and transmitting functions therein such that a position and orientation of a munition with respect to a target, can be calculated on board the munition and relayed to the platform. Performing the processing on board overcomes the space limitation imposed on the platform, thus enabling, by utilizing a platform mounted receiver such as the radio communication system inherent to the platform, to receive signals directly from the munition and as such to asses in real time the impact success or failure of a munition.

According to a preferred embodiment of the present invention the signal transmitted by transmitter 28 is a radiofrequency signal which is receivable by a radiofrequency receiver of platform 27. Preferably the receiver is inherent to a radio communication system of platform 27

According to another preferred embodiment of the present invention the radiofrequency signal transmitted by transmitter 28 is of ultra high frequency selected between 200 megahertz and 400 megahertz with a band width of 6–9 kHz.

As is specifically shown in FIG. 2, to enable generation and transmission of an RF signal of this frequency range and band width transmitter 28 includes a control and interface unit 30 which serves to receive the signal (indicated by 29) from processing unit 26. Transmitter 28 also include a modulator 32 which serves to convert the voice information signal or in addition digital data, such as image data, signal into a radiofrequency signal (indicated by 31) and to relay the radiofrequency signal to a power amplifier 34 such that the RF signal can be amplified thereby prior to transmission via UHF antenna 36.

The RF signal received by a receiver on board platform 27 is then translated thereby to information indicating either success or failure of impact, of munition 10.

Thus, the transmission of the RF signal is preferably effected during the last minute of flight of munition 10, more preferably during the last few seconds of flight. Initiation of transmission can be determined according to the proximity of munition 10 to the target which can be determined according to information from guidance system 18. It will be appreciated that the RF signal can be transmitted from munition 10 from the moment of release until impact in which case an operator of platform 27 can choose to ignore the signal until a minute or so prior to impact.

It will be appreciated that the ability to forecast impact success is inversely proportional to the distance between munition 10 and the target. That is to say, the closer munition 10 is to target (i.e., the less time remaining to impact) the more accurate the impact success or failure forecast is. It will further be appreciated that if this forecast is effected on the basis of information transmitted from munition 10 a few seconds prior to impact such a forecast is substantially 100% reliable.

Thus, by utilizing radio communication no modifications or addition of hardware to the platform are necessary, greatly simplifying deployment of munition 10 of the present invention. In addition, since the radio communication system inherent to platform 27 is utilized as a receiver, minimal operator training and handling is required.

According to another preferred embodiment of the present invention the radiofrequency signal is translated into audio information by the radio communication system of platform 27. Such audio information can include uttered words (voice) or any other form of audio information which is indicative of impact success or failure. For example, this information can include either a "hit" or a "miss" message, which indicates to the operator of platform 27 an impact success or failure. It will be appreciated that through experimentation it will be possible to determine which uttered words or combinations of words and which voice frequencies and intonations are best suited for the relaying the munition impact success or failure message to an operator of platform 27. It will be appreciated in this respect that voices of male, female and child are readily discernible and the content thereof identifiable even if simultaneously transmitted through a multiple users communication system.

As specifically shown in FIG. 3, the communication system of platform 27 includes a UHF receiver 40 provided with an antenna 39 for receiving the RF signal generated by transmitter 28. As already mentioned above the incoming RF signal is converted into audio information, preferably voice, as indicated at 41, which is receivable and comprehended by an operator 50 of platform 27. In addition, the audio information, as well as digital data information, such as image data, can be recorded on a voice tape recorder (VTR) 42 for later analysis by a ground station. Digital data can be transmitted, for example, by on/off key modulation.

According to another preferred embodiment of the present invention when the impact success of more than one munition 10 is to be co-assessed, the signal generated and transmitted by impact verification assembly 24 of each munition 10 also includes information uniquely identifying each munition 10.

It will be appreciated that since in, for example, aerial bombing runs more than one munition 10 is deployed either by a single or a plurality of airplanes targeting one or more targets, individually tracking and assessing impact success of each munition 10 must be enabled.

In such cases, each munition 10 is preprogrammed to transmit a signal including a unique identifier in addition to the information pertaining to impact success or failure. The unique identifier can be for example audio (e.g., voice) information including, for example, a single word selected from the words representing the international alphabet of radio communication (Alpha, Bravo Charlie etc.). Thus munition 10 can transmit a signal such as Alpha-"hit" which identifies the specific munition 10 and the impact success or failure thereof;

In order to discern between the signal transmitted from a plurality of munitions 10 co-deployed the signal of each specific munition 10 is transmitted in a random manner over a time period such that each signal is individually received at least once over this time period by platform(s) 27.

For example, when three munitions 10 are co-launched from an airplane or airplanes a suitable transmission time window, a number of time windows in a time period and a number of transmissions in each time window, can be determined such that signals from munitions 10 are individually received by platform 27 at least once during this time period.

Thus, for three munitions, the probability of successful transmissions non-overlapping) over a time period can be represented as follows: $P=n\times(n-1)^2/n^3$, wherein n=the number of time windows over a time period, $n^3$=the number of possible co-transmission for three munitions 10 in a time window, and $n\times(n-1)^2$ the number of possible non-overlapping transmissions in a single time window.

Thus, 1−P is the probability of an unsuccessful transmission (i.e., if two transmissions overlap and thus cannot be individually discerned) if Z is the number of time windows necessary and if X is a successful transmission then $X=1-(1-P)^Z$. Extracting Z yields the following: $Z=\log(1-x)/\log(1-P)$.

Assuming a one second transmission time and applying the above calculations for three munitions 10, yields an optimal time period of 28 seconds which includes 4 time windows of 7 seconds each, for obtaining probability of 99.5% of non-overlap. As specifically shown in FIG. 4, if all three munitions (represented by bomb 1, 2 and 3) are transmitting (each transmission, i.e., transmit frame, is represented by a single rectangle) randomly over this time period (time windows 1–4), each signal is individually received by the receiver of platform 27 at least one time during this time period (time window 3). It will be appreciated that by increasing the number of time windows or the number of optional transmissions per window one can increase the non-overlap probability.

Thus the present invention provides a self guided munition including an impact verification assembly which enables the operator of a platform from which the munition was dropped or launched to determine, in real time, an impact success or failure of the munition.

The self guided munition of the present invention can readily be incorporated and deployed by existing platforms without necessitating additional platform mounted hardware or extensive operator training. In addition the self guided munition of the present invention enables the co-assessment of impact success of a plurality of munitions which are targeted against one or more targets.

It will be appreciated that assembly 24 of the present invention can be retrofitted into any existing self guided munition, providing suitable coupling conduits are provided such that communication with a guidance system can be established.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A system for determining the impact success of a self guided munition which is launched or dropped from a platform, the system comprising an impact verification assembly being integrateable into the self guided munition, said impact verification assembly including:

(a) a processing unit for receiving and processing information from an onboard guidance system of the self guided munition, said information pertaining to an in-flight trajectory position of the self guided munition prior to impact, said processing unit further being for generating a signal including information pertaining to an accuracy of said in-flight trajectory position of the self guided munition prior to impact with respect to a target; and (b) a transmitter being in communication with said processing unit, said transmitter being for transmitting said signal generated by said processing unit in a manner receivable by a receiving device of the platform;

wherein said signal pertaining to said accuracy of said in-flight trajectory position of the self guided munition prior to impact includes information indicating an impact success or an impact failure of the self guided missile.

2. The system of claim 1, wherein said signal is a radiofrequency signal and further wherein said receiving device of the platform is a radiofrequency receiver.

3. The system of claim 2, wherein said radiofrequency receiver is inherent to a radio communication system of the platform.

4. The system of claim 2, wherein said radiofrequency signal is an ultra high frequency radio signal of between 200 megahertz and 400 megahertz.

5. The system of claim 2, wherein said radiofrequency signal is translatable into audio information.

6. The system of claim 5, wherein said audio information includes uttered words.

7. The system of claim 1, wherein, in a case where the impact success of more than one of the self guided munition is to be co-assessed, said signal generated and transmitted by said impact verification assembly of each self guided munition also includes information uniquely identifying each self guided munition.

8. The system of claim 7, wherein said information uniquely identifying each self guided munition is transmitted as a radiofrequency signal and further wherein said receiving device of the platform is a radio frequency receiver.

9. The system of claim 8, wherein said radio frequency signal is translatable into audio information.

10. The system of claim 9, wherein said audio information includes uttered words.

11. The system of claim 10, wherein said uttered words include words of the international alphabet of radio communication.

12. The system of claim 7, wherein said signal generated and transmitted by said impact verification assembly of each self guided munition is randomly transmitted a plurality of times over a time window.

13. The system of claim 1, wherein said impact verification assembly further includes a power supply for powering said processing unit and said transmitter.

14. The system of claim 1, wherein said impact verification assembly includes an interface for connecting to a power supply of the self guided munition.

15. The system of claim 1, wherein said information pertaining to said in-flight trajectory position of the self guided munition includes a position and orientation of the self guided munition with respect to a location of said target.

16. The system of claim 15, wherein said target is selected from the group consisting of a stationary target and a moving target.

17. The system of claim 1, wherein said transmitter transmits said signal generated by said processing at any time point within a minute prior to impact.

18. A method of determining the impact success of a self guided munition which is launched or dropped from a platform, the method comprising the steps of:

(a) processing information generated by an onboard guidance system of the self guided munition, said information pertaining to an in-flight trajectory position of the self guided munition prior to impact;

(b) generating a signal including information pertaining, to an accuracy, with respect to a target, of said in-flight trajectory position of the self guided munition prior to impact; and (c) transmitting said signal generated by said processing unit in a manner receivable by a receiving device of the platform so as to enable to determine the impact success of the self guided munition;

wherein said signal including said information pertaining to said accuracy, with respect to said target, of said in-flight trajectory position of the self guided munition prior to impact includes information indicating an impact success or an impact failure of the self guided munition.

19. The system of claim 18, wherein said signal is a radiofrequency signal and further wherein said receiving device of the platform is a radiofrequency receiver.

20. The system of claim 19, wherein said radiofrequency receiver is inherent to a radio communication system of the platform.

21. The system of claim 19, wherein said radiofrequency signal is an ultra high frequency radio signal of between 200 megahertz and 400 megahertz.

22. The system of claim 19, wherein said radiofrequency signal is translatable into audio information.

23. The system of claim 22, wherein said audio information includes uttered words.

24. The system of claim 18, wherein the step of transmitting said signal generated by said processing unit is effected at any time point within a minute prior to impact.

25. A system for determining the impact success of a self guided munition which is launched or dropped from a platform, the system comprising an impact verification assembly being integrateable into the self guided munition, said impact verification assembly including:

(a) a processing unit for receiving and processing information from an onboard guidance system of the self guided munition, said information pertaining to an in-flight trajectory position of the self guided munition prior to impact, said processing unit further being for generating a signal including information pertaining to an accuracy of said in-flight trajectory position of the self guided munition prior to impact with respect to a target; and (b) a transmitter being in communication with said processing unit, said transmitter being for transmitting said signal generated by said processing unit in a manner receivable by a receiving device of the platform;

wherein, in a case where the impact success of more than one of the self guided munition is to be co-assessed, said signal generated and transmitted by said impact verification assembly of each self guided munition also includes information uniquely identifying each self guided munition.

26. A system for determining the impact success of a self guided munition which is launched or dropped from a platform, the system comprising an impact verification assembly being integrateable into the self guided munition, said impact verification assembly including:

(a) a processing unit for receiving and processing information from an onboard guidance system of the self guided munition, said information pertaining to an in-flight trajectory position of the self guided munition prior to impact, said processing unit further being for generating a signal including information pertaining to an accuracy of said in-flight trajectory position of the self guided munition prior to impact with respect to a target; and (b) a transmitter being in communication with said processing unit, said transmitter being for transmitting said signal generated by said processing unit in a manner receivable by a receiving device of the platform;

wherein said impact verification assembly includes an interface for connecting to a power supply of the self guided munition.

* * * * *

UNITED STATES PATENT AND TRADEMARK OFFICE

CERTIFICATE OF CORRECTION

PATENT NO. : 6,474,592 B1
DATED : November 5, 2002
INVENTOR(S) : Shnaps

It is certified that error appears in the above-identified patent and that said Letters Patent is hereby corrected as shown below:

Title page,
Item [62], please insert as follows:

-- [62] Related U.S. Application Data
Division of U.S. Application No. 09/449,750 filed on November 26, 1999
now US Patent No. 6,345,784 --

Signed and Sealed this

Tenth Day of June, 2003

JAMES E. ROGAN
*Director of the United States Patent and Trademark Office*